US006148584A

United States Patent [19]

Wilson

[11] Patent Number: 6,148,584

[45] Date of Patent: Nov. 21, 2000

[54] TRIM ATTACHMENT SYSTEM

[76] Inventor: Bryan A Wilson, 272 Foucault Drive, Espanola ON, Canada, P5E 1N8

[21] Appl. No.: 09/117,671

[22] Filed: Jul. 31, 1998

Related U.S. Application Data

[63] Continuation-in-part of application No. PCT/CA96/00065, Feb. 2, 1996.

[51] Int. Cl.[7] ..... E04F 19/02; E06B 1/62

[52] U.S. Cl. ..... 52/717.01; 52/211; 52/718.02

[58] Field of Search ..... 52/211, 204.53, 52/204.54, 717.01, 717.04, 718.01, 718.02, 718.03, 718.04, 718.05, 718.06, 179, 188, 287.1, 288.1, 212; 49/504, DIG. 1, DIG. 2

[56] References Cited

U.S. PATENT DOCUMENTS

| | | | |
|---|---|---|---|
| 3,609,928 | 10/1971 | Mock | 52/211 |
| 4,318,951 | 3/1982 | Naka et al. | 52/179 |
| 4,730,432 | 3/1988 | Schafer et al. | 52/287.1 |
| 5,001,877 | 3/1991 | Edwards | 52/288.1 |
| 5,127,204 | 7/1992 | Braun | 52/287.1 |

*Primary Examiner*—Michael Safavi
*Attorney, Agent, or Firm*—Anthony Asquith & Co.

[57] ABSTRACT

Wood trim is attached to the wail around a door, window, etc, by means of an extruded plastic attachment strip. The strip is formed with a hollow box-shaped protrusion which serves as a spline, which engages a complementary groove in the profile of the wood trim. A bar formed in the back of the strip profile serves to hold the strips in complementary slots in the door jamb.

23 Claims, 8 Drawing Sheets

TRIM ATTACHMENT SYSTEM

This application is a continuation-in-part of international application PCT/CA-96/00065, filed Feb. 2, 1996, which designated the United States, and is now abandoned.

This invention relates to wood trim, of the kind used to trim the edges of door frames and window frames, wainscotting, and also baseboards and skirting boards, crown mouldings, etc, in houses and other buildings.

The invention is a development of the technology disclosed in PCT/GB-93/00583, published Sep. 30, 1993 as WO-93/19273.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
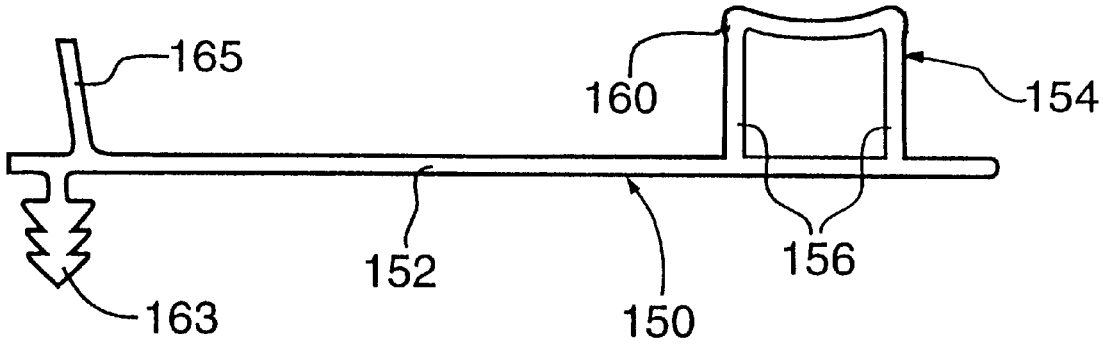
FIG. 1 is a cross-section of a spline-strip, for use in the invention.
Figure 2:
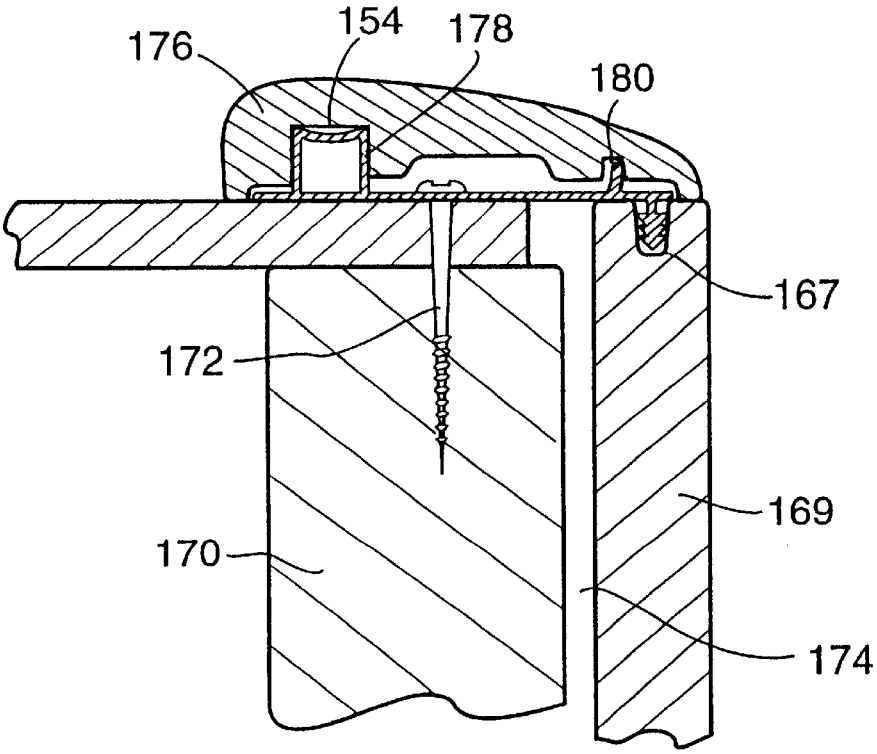
FIG. 2 shows the strip of FIG. 1 in an installation.

FIG. 1 shows a trim attachment strip 150, which is formed as a plastic extrusion. FIG. 2 shows the strip of FIG. 1 in use to attach a piece of wood trim to a wall, associated with a door opening.

The profile of the strip 150 includes a base or web 152, which lies flat against the wall. (The web may be bowed slightly, in profile, so that when the strip is nailed flat to the wall the edges of the profile are pressed against the wall.) Protruding outwards from the web 152 is a spline 154. The spline 154 has the form of a hollow rectangular box, comprising left and right side walls 156 and a roof 158.

The roof 158 is slightly dished or curved, as shown. At the outer corners of the junction between walls and the roof, the profile includes a small, radiused promontory 160. By virtue of the promontories 160, the spline 154 is slightly thicker at its outer end, or roof end.

Protruding inwards (with respect to the wall) from the back of the spline-strip 150 is a protrusion or bar 163. This protrusion is ridged, as shown in FIG. 1.

Protruding outwards from the front of the spline-strip 150 is an inclined rib 165. The rib 165 protrudes not at right angles, but at the slight angular inclination as shown in FIG. 1.

FIG. 2 shows the spline-strip 150 installed. The ridged protrusion 163 engages a groove 167 cut in and along the length of the edge of the (wood) door-jamb-piece 169. By this engagement, the spline-strip 150 and the jamb-piece 169 are locked together against relative lateral movement.

As shown in FIG. 2, the door-jamb-piece 169 is secured in place relative to the door opening by virtue of the fact that the spline-strip 150 is secured to the wall stud 170 by means of screws 172. (Nails, staples, etc, may be used to secure the spline-strip.) The exact position and orientation of the jamb-piece 169 in the opening can be adjusted by adjusting the exact place in which the spline-strip is fixed to the stud.

The jamb-piece as illustrated in FIG. 2 is located at the door-hinge-side of the opening, and it will be understood that the corresponding jamb-piece at the door-open-side of the opening is secured in a similar manner. Also, the jamb-piece of the lintel of the opening is secured in similar manner.

The spline-strip 150, arranged and used as described, provides for a very simple installation of the door-jamb-pieces and the lengths of trim around the door, even though the installer may not be a skilled craftsman. The arrangement as described enables the installation to be done in a manner that make it easy to ensure that the mitred corners of the finishing wood trim will be exactly square and even.

Usually, a door opening is not exactly square and even. The installer may temporarily secure the lintel jamb-piece and spline-strip, and then, with the aid of a set square or jig, align the hinge-side and the open side-jamb pieces and spline-strips. He may install both the inside-the-room and the outside-the-room strips at the same time. Generally, the installer will find that he can easily set the lintel piece first, and then can set the two side pieces exactly at right angles to the lintel piece.

In FIG. 2, it will be noted that no shims are required between jamb-piece and stud in order to hold the jamb-pieces in their correct location in the opening. The jamb-pieces are fully located and constrained by the spline-strips, and by the screws 172. The space 174 is made large enough to accommodate such out of squareness and other unevenness as may be required, to ensure that the jamb-pieces and the spline-strips can be put in place exactly at right angles to each other.

The jamb-pieces 169, spline-strips 150, and the lengths of trim 176, may be pre-made in-factory. The purchaser states the size of the door, and is supplied with the appropriately-sized kit; all the items in the kit are pre-cut to size and all mitres are pre-cut on accurate factory machinery. A kit may be made up of pre-cut and pre-mitred spline-strips; also, pre-cut and pre-mitred lengths of trim (which are not only pre-cut and pre-mitred, but are also fully and finally finished); and also, fully and finally finished jamb-pieces. Since doors come in a limited number of standard sizes, it is economical for wood trim shops to hold stocks of the pre-cut trim, spline-strip, and jamb-pieces in kits for the various standard sizes of door.

The pre-made trim kits provide even the amateur carpenter with a simple way of ensuring that all mitres are not only cut perfectly, but are installed at an accurate right angle. This is in addition to the other benefits of the system: (a) the fact that no nails etc are used to secure the trim means that the trim may be made with a factory-applied finish; and (b) the trim is removable and can be removed and replaced to simplify the task of wall-papering, painting, etc.

In some cases, the installer might wish to remove a sliver of material from the edge of a jamb-piece 169, for example to make the edge lie flush with the wall surface. The grooves 167 should be made deep enough to allow for some material to be removed from the jamb-piece, and still leave the groove deep enough that the ridged protrusion 163 does not bottom in the groove.

The profile of the wood trim 176 may be provided with a space to receive electrical wires running inside the trim. Such wires may be held in place with special clips, which hook into holes drilled in the web of the spline-strip. Alternatively, wires can be secured simply by passing a staple around the wire and through the web.

The trim 176 is provided with a spline-groove 178 and a rib-groove 180. To install the trim to the spline-strip 150, the length of trim is first assembled over the leaning rib 165; the rib 165 bends slightly when the trim is pressed down over the spline 154, resulting in a (slightly) heavier contact force between the rib 165 and the trim 176, and a force which tends to draw the edge of the trim into a slightly tighter contact with the jamb-piece.

The spline-groove 178 and the spline 154 have a slight interference fit, especially over the roof-end of the spline, where, as mentioned, the spline is slightly thicker because of the corner promontories 160. The roof 158 is able to bend (in a buckling mode), to the extent required for the spline 154 to fit in the groove 178 with a good contact force.

The hollow-box form of the spline 154 profile is excellent in providing just the right balance between stiffness and resilience in the spline.

It may be noted that if the spline were solid, only a very limited degree of interference between the spline and the spline-groove could then be allowed—typically about 0.01 mm maximum. The designer dare not provide more interference than that, or the spline-groove 178 in the trim may tend to crack open.

The solid-spline system as described in earlier publications is able to provide excellent retaining and holding power of the trim to the spline, even though the spline has only a light interference, hardly any interference, or no interference at all, with the spline-groove. However, when the spline is made of plastic, in the form of an extrusion in PVC, for example, the coefficient of friction between the PVC of the spline and the wood of the spline-groove can be low enough that the designer wishes to resort to interference to provide the holding power needed.

Heavy interference could not be contemplated when the spline was solid. A solid spline has too little resilience, and if the interference is just slightly too much, the wood trim will crack. On the other hand, if the "spline" were to take the form of two protruding arms, side by side, and cantilevered out from the web, the resilience of such cantilevered arms would then be too much: it would not in that case be possible to develop enough contact force between such arms and the sides of the spline-groove to give enough holding power.

It may be regarded that in the hollow-box profile of the spline the roof 158 serves to hold the outer ends of the left and right walls 156 apart. The roof 158 is resilient enough, in the bending/buckling mode, to allow the walls to bend inwards slightly, if the groove should be cut narrow, and yet enough interference is provided to ensure good holding power if the groove should be cut on the wide end of its permitted tolerance range. This just-right degree or rate of resilience of the spline is enhanced if the roof 158 is given the nominal curvature, as shown.

The thickness of the roof can be adjusted, also, to provide just the right degree of resilience: it has been found that making the roof slightly thinner than the walls can help give the right balance between a too-hard spline, which has no "give" and splits the wood trim if the groove is slightly too tight, and a too-soft spline, in which the spline does not provide enough grip to the sides of the groove. The hollow-box design of spline enables the spline to grip the trim tightly enough for good securement, over a tolerated range of groove widths.

The degree of resilience attributable to the hollow-box profile of the (plastic) spline may be expected to provide holding power over a tolerance range of the order of 0.02 mm.

The hollow-box profile allows a greater dimensional magnitude of interference between spline and spline-groove than was the case with the solid spline. In the context of plastic splines: on the one hand, a solid plastic spline has hardly enough resilience to permit any interference; on the other hand, two cantilevered arms would have too much resilience. But two cantilevered arms joined by a roof (which is what the hollow-box profile amounts to) has just the right degree of resilience to provide a good holding force without demanding difficult-to-manufacture tolerances. Interference-fits generally require tight tolerances: the hollow-box profile for the plastic spline eases that requirement enough that a factory-cut groove in a length of solid oak or other wood trim can be accurate enough.

A problem that can sometimes arise with mitred corners is that the wall is not quite flat in the plane of the wall. As a result, at a mitred corner, the horizontal lintel trim might protrude perhaps a half-millimeter further out from the wall than the vertical trim. Even though the mitre might be exactly a right angle, such protrusion-mismatch can be quite noticeable.

Figure 3:
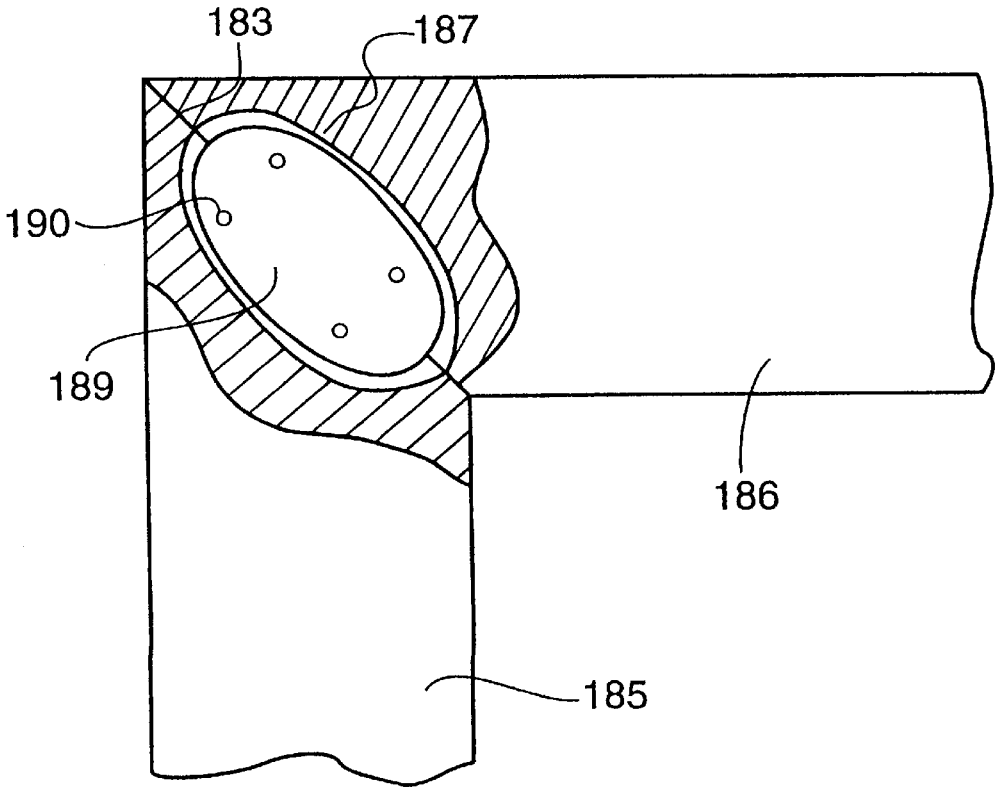
FIG. 3 shows a mitered corner between two lengths of trim.

FIG. 3 shows how the lengths of trim may be joined together at the mitred corners, in a way that eliminates protrusion-mismatch. The mitred edge 183 of the vertical length of trim 185, and the corresponding mitred edge of the horizontal length of trim 186, are provided with slots 187, into which is inserted a biscuit 189. The biscuit 189, conventionally, is a piece of hardwood or plastic sheet formed to the oval shape as shown. The biscuits may be glued in place, or, if the trim profile is of appropriate thickness, the biscuits may be screwed in place, as at 190. Of course, the screws are screwed in from the back of the trim, and must be short enough not to extend right through the trim.

In FIG. 3, the trim lengths 185,186 are secured together before being placed on the wall. This means that the installer must be able to rely on the accuracy of the mitres, as cut, in both the trim lengths and the spline-strips. It will be understood that securing the trim-lengths together with biscuits, and then placing the secured-together trim-lengths on the spline-strips, poses a very demanding requirement for accuracy of the mitres and of the dimensions of the pieces. However, such accuracy is available if the mitred joints between the trim lengths and the spline strips are factory-made to suit the particular door size. The pre-grooved door-jamb-pieces 169 should be included also in the same kit.

It is recognised that the in-factory-accuracy of making the mitred joints in this way is not wasted nor compromised, even if the door opening is (as they usually are) not truly accurate and square.

It is convenient to join the lintel trim-length to the two vertical trim-lengths, by means of the biscuit connectors, just before the sub-assembly comprising the three trim-lengths is applied to the already-installed spline-strips. The sub-assembly of the three trim-lengths is awkward, and vulnerable to transit damage; however, a professional trim installer may be willing to take the trouble to handle the vulnerable assembly with the needed care, in exchange for the benefits of pre-making and pre-gluing the biscuit connectors in-factory.

Pre-making the sub-assembly of the trim-lengths by pre-gluing biscuit connectors into the joints is much more efficacious in the case of window trim. With window trim, there are four lengths of trim, in the form of an enclosed rectangle. A window trim sub-assembly, being an enclosed rectangle, is much more robust than a door trim sub-assembly, and can be expected to survive handling by amateur craftsmen. However, it will be appreciated that the need for accurate cutting of the lengths and of the mitre angles is very pressing when the trim is installed as a sub-assembly onto the already-installed spline-strips; such pre-making of the sub-assembly is only possible when the pieces are supplied together, in a kit, having been made on accurate machinery.

In fact, if there is protrusion-mismatch of the trim-lengths at a mitred joint because the wall surface is not quite flat, the two spline-strips making up the joint also may be expected to have the mismatch. Indeed, in some cases, if the mismatch of the spline-strips is eliminated, there will be no need to cater for mismatch in the trim itself. Certainly, the installation and attachment of the trim lengths (and the possible detachment of the trim-lengths at some future time) is much more convenient if the trim-lengths are not permanently glued together as a pre-made sub-assembly.

Figure 4:
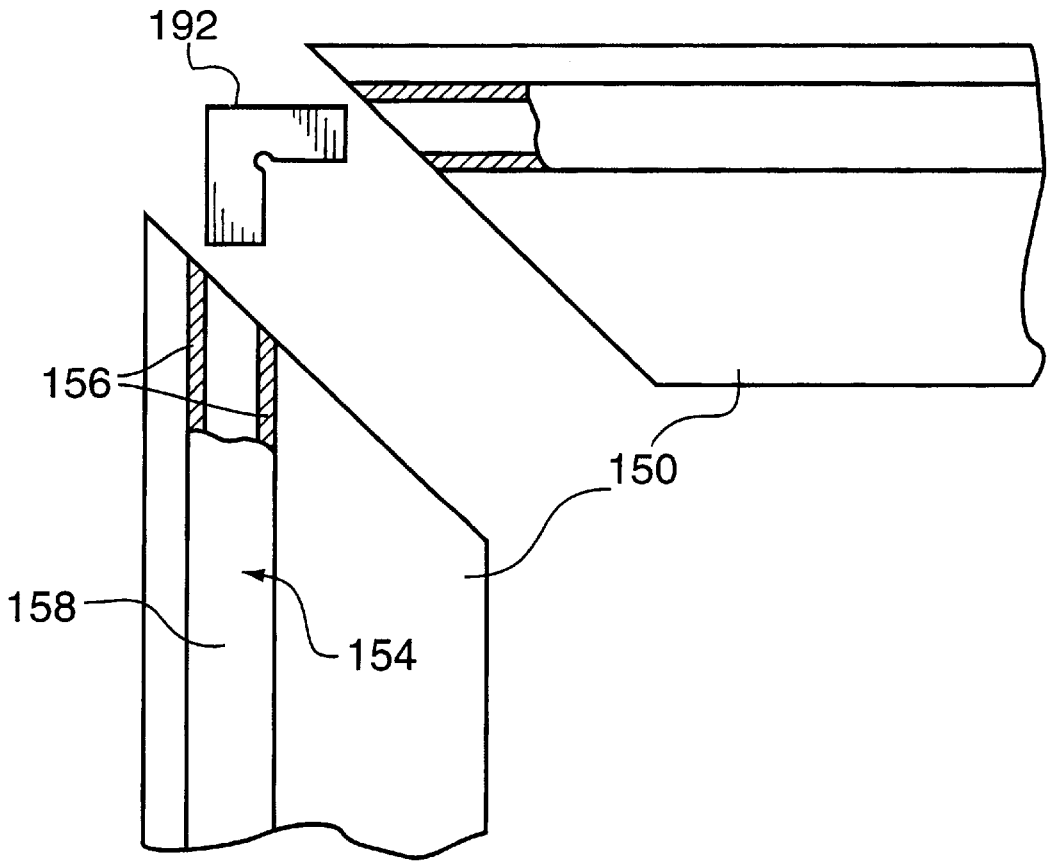
FIG. 4 shows a mitred corner between two spline strips.

Catering for possible protrusion-mismatch between mitred spline-strips is very simple, in view of the hollow-box profile of the spline-strip. As shown in FIG. 4, injection-moulded plastic corner-pieces 192, having a rectangular form which fits the hollow interior of the spline 154, are inserted into the splines at the mitred corners. When the spline-strips 150 are screwed or nailed to the wall, the corner-pieces 192 constrain and hold the two spline-strips at the same protrusion level, even if the wall should be (slightly) uneven.

The corner-pieces 192 may serve in this way equally for door trim as for window trim.

More than one spline or rib may be provided on the strip, having also a hollow interior, and corresponding corner pieces may be provided for that also.

A preferred way of installing the trim and its mounting system may be described as follows. The lengths of trim, the spline-strips, and the door-jamb-pieces, are all, pre-mitred, and pre-finished, in-factory, and are purchased by the installer as a kit for a particular width of door, or door opening. The kit is opened in the room, and the door-jamb-pieces are assembled, on edge, on the floor. The spline-strips for the inside of the room are assembled to the door-jamb pieces; the ribbed protrusions 163 are entered into the groove 167 while the jamb-pieces are still laid on the floor.

The door-jamb pieces may now be secured together at the mitred corners, using appropriate fasteners. (Of course, these fasteners should be so arranged as not to be visible after installation.)

The assembly comprising the fixed-at-the-corners jamb-pieces and the inside-the-room spline-strips, which are already assembled to the jamb-pieces, may now be lifted off the floor of the room, and the assembly placed in the door opening. The installer will generally be able to tell, by eye, by looking at the mitred comers, both of the jamb-pieces and of the spline-strips, whether the corners are accurately at right angles. It may be regarded that if the installer cannot see any out-of-squareness at the corner by looking at the line of the mitre, then the out-of-squareness is so small it can be ignored. Set squares and other instruments are generally not required. The installer must be able to "trust" the mitres for squareness, but this is acceptable with factory-made mitres.

The spline-strips are secured to the wall when the installer is satisfied, looking at the lines of the mitres, that the corners are square. The door jamb-pieces are secured by securing the spline-strips to the wall. Once the inside-the-room spline-strips are secured, the outside-the-room spline-strips may be installed, using the grooves 167 cut in the far edges of the jamb-pieces. The outside-the-room spline strips are secured to the wall also.

The jamb-pieces and the spline-strips having been installed with accurately-square corners, in this manner, the lengths of wood trim may now be assembled to the splines. The installer may be confident that the mitred corners of the wood trim will look square (and indeed will be square), provided the installer took a little trouble to ensure the mitred corners of the spline strips looked square, by looking at the mitre-line.

When installing the spline-strips and the wood trim in a case of renovation, rather than original installation, it will generally be impractical for the jamb-pieces to be provided with grooves 167. For renovation work, therefore, the spline-strip is provided without the protrusion 163. Also, for window trim, the protrusions 163 will not be present.

Even though, for renovation, there is no protrusion-in-groove engagement between the jamb-pieces and the spline-strips, out-of-squareness of the door jamb can be accommodated (within limits) simply by the placement of the spline-strips. For renovation, the installer relies on looking at the line of the mitre to indicate when the spline-strips are square; he does not rely on the alignment of the strips with the existing door (or window) jamb. The installer looks at the line of the mitre (a distance of about 8.5 cm if the spline-strips are 6 cm wide) and makes sure the mitre line appears to be the same thickness all along its length. With only a minimal skill, the installer can fix the spline-trim with its corners square enough that the corners in the finished wood trim, when the wood trim comes to be pressed onto the splines, appear to be perfectly aligned.

Figure 5:
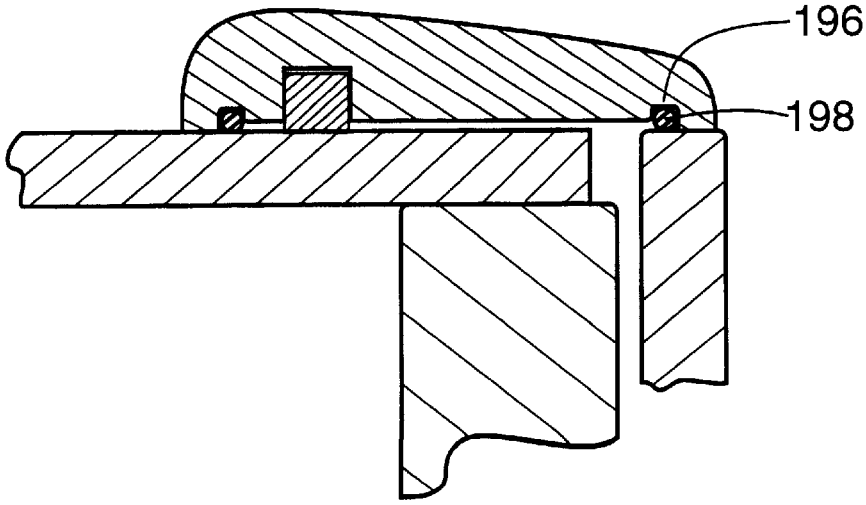
FIG. 5 shows trim to which draft-excluding seals have been added.

FIG. 5 shows a useful variation to the trim, in which further grooves 196 are provided in the cut-profile of the trim. Rubber sealing strips 198 are carried in the grooves 196, and serve to prevent drafts which may be emanating from inside the (hollow) wall and from the space 174, from leaking around the trim.

Figure 6:
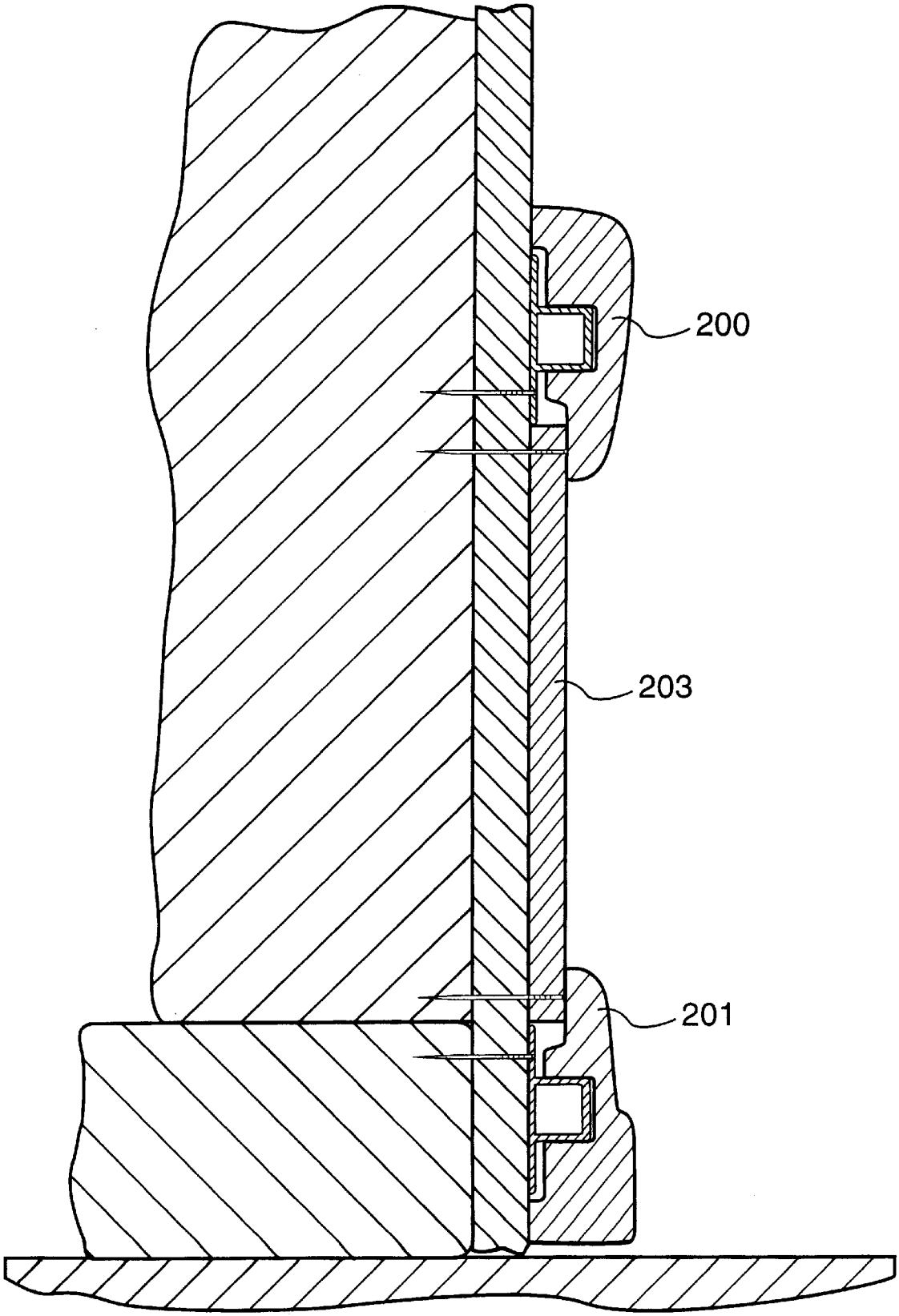
FIG. 6 is a cross-section of a baseboard installation.

FIG. 6 shows another manner in which the invention may be applied: for wide trim, such as may be required for a baseboard, the trim may be provided in, for example, three sections. The outer two sections 200,201 are attached by means of the spline attachment system of the invention, whereas the middle section 203 is screwed in place. Normally, the screws holding the middle section remain concealed by the outer two sections. When decorating the room, the outer two sections, being spline-held, can be removed. A similar arrangement may be employed also for crown moulding trim.

Figure 7:
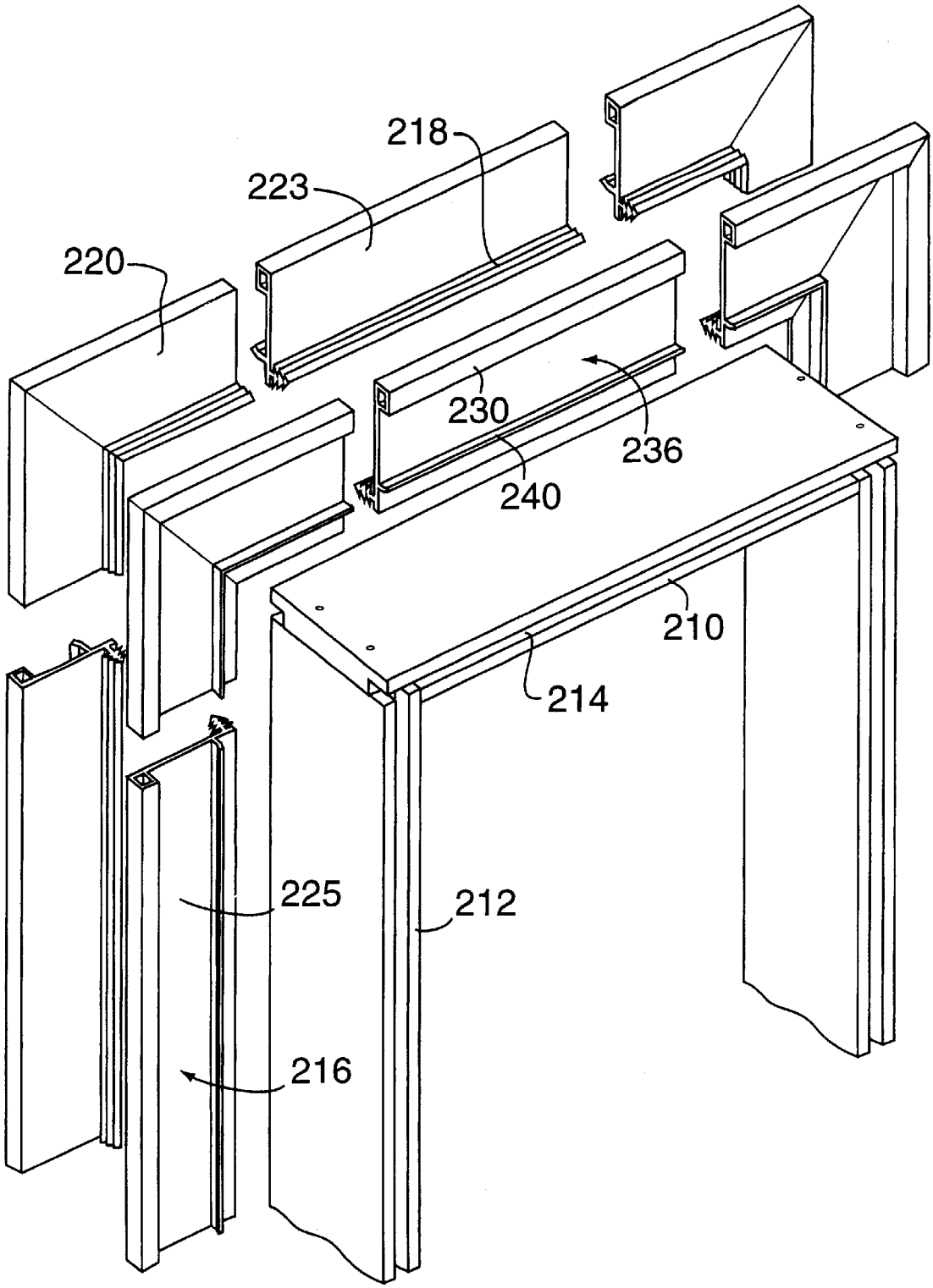
FIG. 7 is a pictorial view of a kit of components for a trim system.

FIG. 7 shows a kit of components, as may be used for securing trim around a door, when the application is of such a kind that the door jamb can be made specially to suit the trim system. It can be arranged, in that case, in particular, that the door jamb pieces 210,212 may be provided with slots or grooves 214 along their edges (similar to FIG. 2). The spline-strips 216 are provided with integral barbed or ridged bars 218, which engage the groove.

Bearing in mind that the spline-strips 216 are present on both sides of the door, such a fixing system is extraordinarily strong, even though the bars 218 are simply pressed into the grooves 214. The door jamb pieces 210,212 need not in fact be screwed to the door frame at all, themselves, but can be held in place entirely by means of the spline-strips 216. (The spline strips of course are nailed or stapled, through the plasterboard, to the door frame in the wall.) The carpenter may attach the door hinges, latch, etc, to the jamb pieces with full confidence that even if the door were to be slammed hard the jamb is rigidly secured. Also, the jamb-pieces may be pre-finished, in-factory, since no through-fasteners (which might damage the finish) are required to hold them in place.

In some installations, the width of the wall is not quite the same as the width of the jamb-piece 210,212, or the wall may be slightly bowed. Mis-match due to thickness variations or lack of straightness can easily be accommodated (within limits, of course) by the spline-strips 216, which are fairly flexible in the plane of the wall, and yet still the jamb-pieces are held very firmly in place relative to the wall, by virtue of the securement of the spline strips to the wall.

The bars 218, being barbed, remain firmly secured to the jamb-pieces, once assembled therein. The force on the groove 214 is considerable, but the jamb-piece (much more so than the trim) is thick and chunky, and is not prone to cracking due to the heavy forces. Although the wood trim can be removed from the spline-strips by hand manipulation, the barbed bars 218 are a barely-removable fit in the grooves 214.

The kit of components of FIG. 7 includes corner pieces 220 of the spline-strip. To form these corner pieces, two pieces of the plastic spline-strip extrusion are cut off at (exactly) 45 degrees. The two pieces are welded together at (again exactly) 45 degrees. These manufacturing processes can be carried out in-factory, where the required degree of accuracy is easy to obtain.

To assemble the kit of components, first the corner-pieces 220 are pressed into the horizontal and vertical jamb-pieces 210,212. This is done on both sides of the wall, ie inside and outside the room. (The wood trim is absent at this time.) Next, the corner-pieces are attached to the wall, by screwing, stapling. etc. With the corner-pieces of the spline-strip secured to the jamb-pieces, it is ensured that the intersections of the jamb-pieces are accurately at right angles, simply by fixing the corner-pieces of the spline-strip to the wall while the corner-pieces are assembled to the jamb-pieces. Both the inside and outside corner-pieces are secured at this time.

Next, the horizontal and vertical fill-in pieces 223,225 of the spline-strip are cut to length, their barbed bars 218 pressed into the grooves 214 in the jamb-pieces, The fill-in pieces are fixed to the wall, again both inside and out. No particular care and skill is needed to align the fill-in pieces of spline-strip with the jamb-pieces. Each is constrained by the other to adopt the correct position, without the need for measurements, or marking out, etc, by the carpenter.

The jamb-pieces 210,212 are secured to the spline-strips 216 over their whole lengths, which is why the securement of the jamb-pieces is so firm and rigid. In other installations, when door shims are used for example, jamb-pieces are secured at only perhaps two or three points along their lengths.

Finally, the trim 227 (FIG. 8) is pounded on. In the kit, the horizontal piece of trim is pre-cut, in the factory, to match the nominal door size; that is to say, to match exactly the width of the horizontal jamb-piece 210. The vertical pieces of trim may be arranged to be cut to the correct height by the carpenter, the mitred corners of the vertical of trim being done in the factory.

The fixing of the spline-strip 216 is done by inserting screws into the spline 230 itself—the spline being hollow, the screws go through clearance holes in the roof 232 of the spline, and abut the floor 234 of the spline. Staples (or screws, or nails, or other suitable fasteners) may be inserted through the main flat area 236 of the spline-strip, into the wall.

The use of the pre-made corner-pieces 220 makes it substantially less demanding to arrange that the piece of trim, when assembled, fit exactly together. The arms of the corner 220 are long enough to ensure the pieces of trim are forced to be correctly aligned to the corner-pieces.

Figure 8:
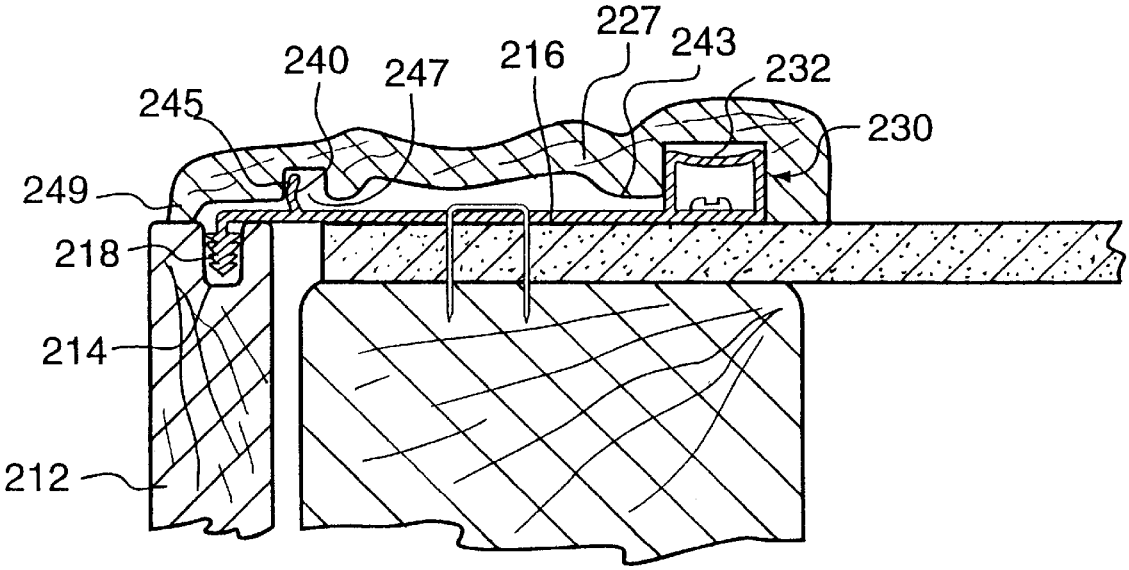
FIG. 8 is a cross-section of another spline-strip.

In FIG. 8, the spline 230 itself has the bowed and slightly thinned roof 232, as previously described. The side walls 238 of the hollow spline are plain, and may be straight (parallel) or may have a slight draft angle.

In FIG. 8, the rib 240 is curved. The curved rib 240 interacts with the profile 243 of the trim piece in such a way that the rib presses forcefully against the side 245 of a groove 247 cut in the trim. The friction arising from this forceful contact holds the inner end 249 of the trim tight against the wall. (If only the main spline 230 were provided, i.e. if the rib 240 were not present, the inner end 249 of the trim might tend to lift.)

In the case of the installation of wood trim to preexisting buildings, the following points may be noted. Although the grooves in the jamb-pieces can be readily provided in new installations, it is, in general, not possible to provide grooves in the jamb pieces if the jamb pieces are already in existence in the building.

Figure 10:
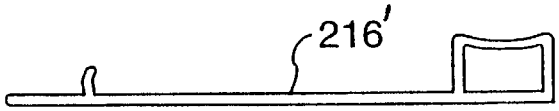
FIG. 10 is a cross-section of another spline-strip.

Thus, for home-improvement installations, there are no grooves on the jambs, and no barbed ribs or bars on the profile of the spline-strip 216' (FIG. 10). Still, the pre-made corners may be used with advantage.

First, the carpenter cuts the horizontal trim-piece with mitred ends, suitably to fit the door size. (Or, lumber stores may stock already-mitred-both-ends pieces of trim to suit standard door widths.) The carpenter assembles the two corner pieces to the horizontal trim piece, and presents those components in place on the wall, and marks the wall. He removes the corner pieces from the trim, and then nails the corner-pieces to the wall, in the positions as marked. A horizontal fill-in piece of spline-strip may be out slightly shorter than the space left between the corners-pieces, and this fill-in piece now in turn is pressed into the horizontal trim; the trim is then assembled lightly to the already fixed corner, and marks are made on the wall for the line of the fill-in piece. The trim is removed, and the fill-in piece nailed to the marks on the wall.

The carpenter can place the vertical piece of spline-strip similarly accurately. With all the spline strips all in place, finally the trim can be pounded on.

For home-improvement installations, more care is needed for marking and placement of the spline-strips than when the spline-strips were located in the grooves in the jamb-pieces. But still, the amount of care and attention with marking and placement, needed to make the trim appear neat (and especially for the mitred corners to fit accurately) is much less than with many conventional installation systems.

Figure 9:
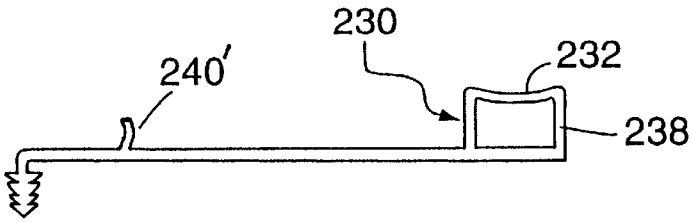
FIG. 9 is a cross-section of another spline-strip.

In the version of the profile shown in FIG. 9, the rib 240' is arranged to face the other way, i.e. to touch the other side of the groove of the trim. Now, the pressure between the rib 240' and the side of the groove 247 drives the profile of the plastic spline-strip into tension and the profile of the wood trim into compression, an arrangement that may be preferred in some cases.

It is emphasised that the above-described trim fixing systems are particularly suitable when the trim is of solid wood of the kind used for decorative trims, e.g. oak. It is a demanding task to secure solid wood trim, because the wood has a tendency to split at the corners of grooves. Therefore, the splines cannot be too tight a fit in the grooves: as explained, it is only when the splines and the grooves engage each other over their whole lengths that a nominally loose fit is found to be tight enough to hold the trim in place.

It may be noted that extruded plastic can change dimensions by as much as 2–3% with changes in humidity and temperature. Obviously, the householder does not want the trim to fall off in the winter, and by engineering the fit to obtain over the width of a relatively thin (e.g. 1 cm) spline, such percentage dimensional changes have insignificant effect on the fit. If the fit were between two surfaces that were, say, 5 cm apart, instead of 1 cm apart, the change of dimensions might easily lead to trim fall-off problems.

FIGS. 11–17 show another manner of arranging the trim attachment system.

One of the difficulties in providing solid wood trim is that the trim is so rigid that the trim does not easily conform to any slight undulations there might be in the side edge surface of the door jamb. As a result, if the door jamb does have undulations, although the inner lip of the trim might touch firmly against the door jamb at the high spots, elsewhere the lip of the trim might not touch the jamb, with the result that a gap appears. Such a gap, though small, can be very noticeable. FIGS. 11–17 show a way of drawing the inner lip of the trim tightly against the side edge surface of the door jamb.

In fact, a considerable force can be required to press the lip of the trim tightly against the low spots of the door jamb, given the solid (i.e. difficult-to-bend) nature of the wood trim. Therefore, even with an increased force pressing the lip against the jamb, there is still a limit as to the size of the undulations that can be tolerated.

Figure 11:
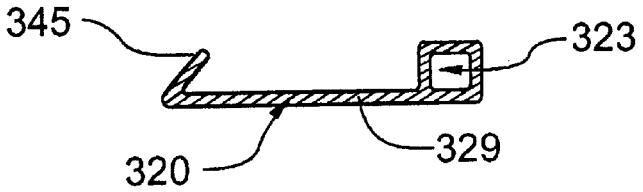
FIG. 11 is a cross section of another trim attachment strip.
Figure 12:
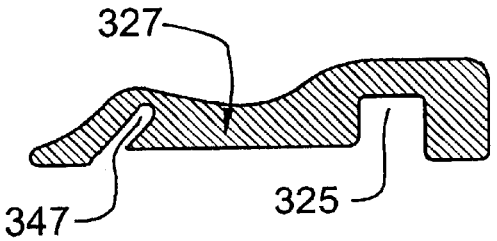
FIG. 12 is a cross section of another trim strip for engagement with the trim attachment strip of FIG. 11.

In FIG. 11, the extruded plastic spline-strip 320 has a profile that includes a hollow spline 323 (the spline being as previously described, and engaging with a complementary groove 325 in the wood trim 327). The extruded profile also includes a flat web 329, by which the spline-strip can be nailed, stapled, etc, through the plasterboard 340, into the door frame stud 342.

Figure 17:
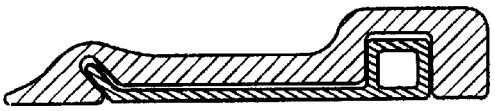
FIG. 17 is a cross section of another form of trim strip and trim attachment strip.

The inner end of the extruded profile includes a tongue 345. The tongue is angled, either forwards as shown in FIG. 11, or backwards as shown in FIG. 17.

The profile of the wood trim 327 (FIG. 12) includes a complementarily-angled slot 347. In manufacturing the trim, the slot 347 is simply cut with an angled saw-blade, which can be done on the same pass in which the overall profile of the wood trim was cut—that is to say, there is no need for the slot 347 to be cut by a separate operation, such as routing.

The slot 347 is a little wider than the thickness of the tongue 345, i.e. the tongue is not tight in the slot. The intention is that the engagement between the angled tongue and the corresponding angled side of the slot gives rise to a force tending to draw the lip of the trim against the door jamb.

Figure 13:
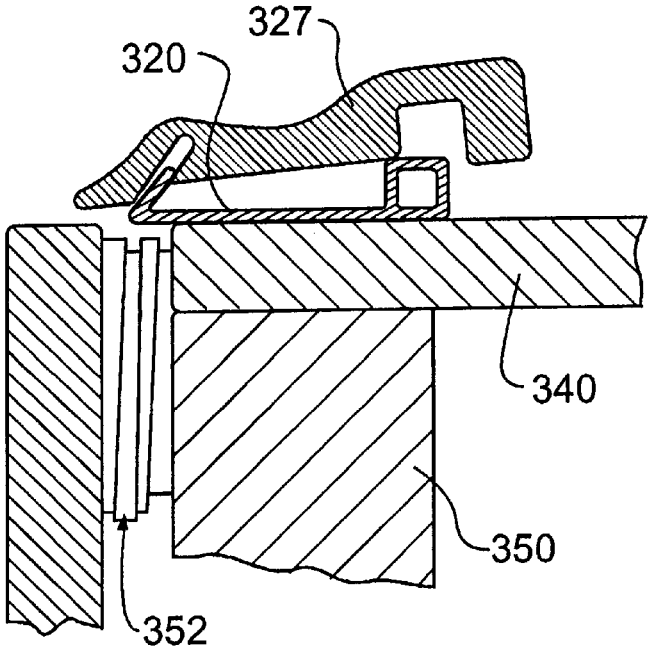
FIG. 13 is a cross section of the trim strip and spline strip of FIGS. 11 and 12 attached to a wall and frame assembly.

The manner of assembling the trim to the extrusion is shown in FIG. 13. The components are so dimensioned that the trim has to be pressed to the left in FIG. 13 in order for the trim to fit over the spline 323. Once the spline is engaged, this leftwards force on the lip-end of the trim is reacted against the spline, and thereby maintained.

The leftwards force serves to drive the tongue 345 more deeply into the slot 347. Insofar as the tongue cannot move away from the wall, the lip of the trim is drawn towards the wall, and into contact with the door jamb.

The force drawing the lip of the trim against the door jamb is reacted by the inherent resistance of the area of the extruded profile against moving away from the wall. If the extrusion were flimsy, the tongue might easily move away from the wall, and there would be little beneficial ability of the tongue and slot arrangement to draw the lip against the jamb. Therefore, the area of the extrusion that includes the tongue should be attached firmly to the wall, and also, that area should be of robust dimensions, so as to be capable of handling the forces acting on the tongue without undue deflection.

Figure 14:
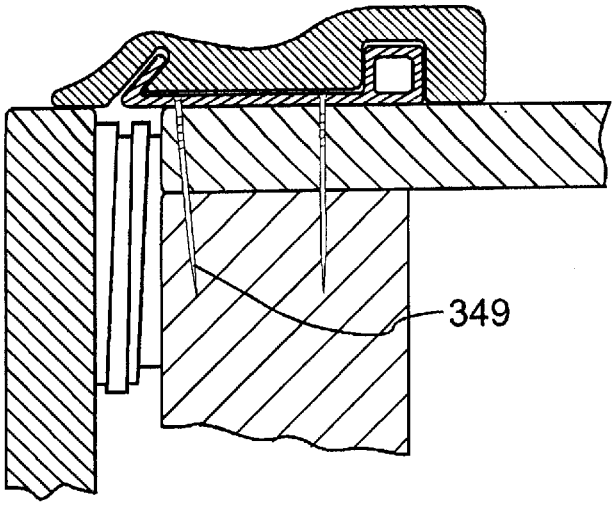
FIG. 14 is a cross section of the trim strip and spline strip of FIGS. 11 and 12 attached to a wall and frame assembly with fasteners in place.

FIG. 14 shows the assembled trim. The fasteners 349 holding the trim to the stud 350 should be reasonably close together, because the plastic is not firmly held against the wall in the spaces between the fasteners, and the profile of the plastic extrusion is not so rigid in the plane at right-angles to wall. On the other hand, the tongue 345 itself, having a considerable height in the direction at right-angles to the wall, lends rigidity for helping keep the extruded profile rigid in the along-the-jamb sense, i.e. in the intervals between the fasteners. Besides not being spaced too far apart, the fasteners 349 should be as close to the tongue as can reasonably be done, as shown in FIG. 14.

As shown in FIG. 14, the trim-installation-contractor should be careful to cut the shims 352 off short. When the trim is being nailed to the wall directly, a slight protrusion of the shims could be accommodated by inserting more nails through the trim. But the contractor has to be more careful now, because with the present trim, if the shims protrude even slightly proud over the surface, it can be expected that a gap will appear between the inner lip of the trim and the door jamb.

Figure 15:
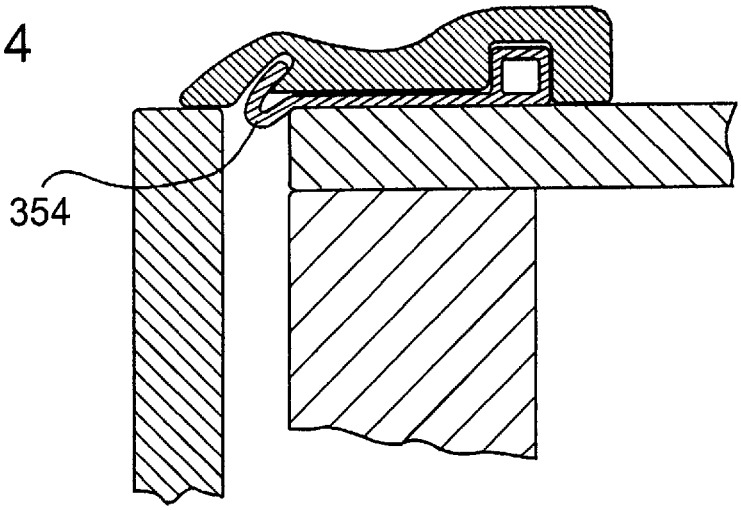
FIG. 15 is a cross section of another form of trim strip and spline strip attached to a wall and frame assembly.

In cases where it can be relied on that the shims, where present, will be recessed below the level of the edge of the door jamb, as shown in FIG. 15, a further enhancement to the extruded profile of the plastic strip can be provided, as shown. Here, there is room for a springy arm 354, on which the tongue can be mounted. A suitable degree of resilience can be built into the springy arm 354, whereby the tongue is able to exert forces on the slot (i.e. forces drawing the lip of the trim into contact with the door jamb) over a wider tolerance range of undulations of the jamb. That is to say, the resilience of the arm 354 enables the FIG. 15 version to accommodate a greater range of undulations of the jamb.

Figure 16:
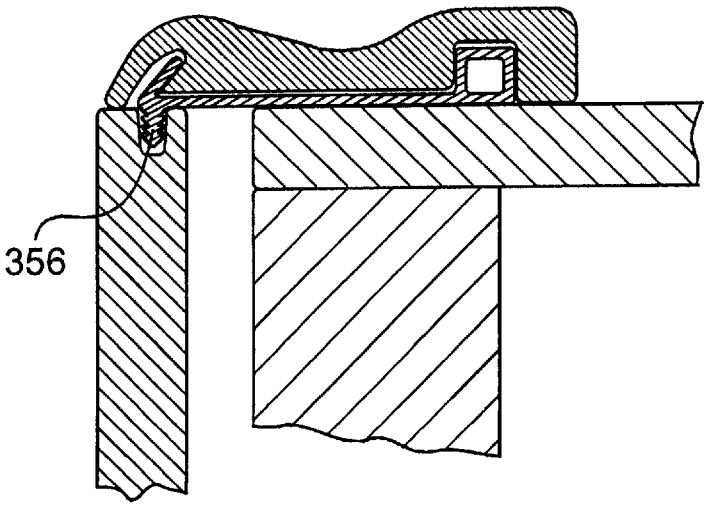
FIG. 16 is a cross section of another form of trim strip and spline strip attached to a wall and frame assembly.

FIG. 16 shows another alternative version, which is similar to the system of FIG. 1, in that a barbed projection 356 firmly retains the inner edge of the extruded profile in a complementary groove in the jamb.

As will be appreciated, the action of the tongue and the corresponding slot relies on the fact that the spline 323 is present. The spline enables a large force between the tongue and the slot to be applied, and to be reacted. It will be noted that the forces as described are generated without the wood being called upon to bend, nor even to snap into an indentation or over a promontory.

FIG. 17 shows the tongue angled the other way. This is less preferred, in that when pieces are to be mitred at the corners, it is easier to assemble mitred pieces from the outside in, rather than from the inside out. Also, angling the tongue the other way puts the wood in tension, whereby the wood is inevitably more likely to crack than where the wood is put under compression.

What is claimed is:

1. An assembly comprising wood trim and a wood trim apparatus, which includes a trim-mounting spline-strip for attaching the wood trim to a wall, around doors and windows, baseboards, corner mouldings, or the like, wherein:

the spline-strip is of plastic, and is elongate, and comprises a unitary structure having the same cross-sectional profile at all points along its length;

the cross-sectional profile of the plastic spline-strip includes a base or web, which is adapted for direct application to a flat surface of a wall;

the cross-sectional profile of the plastic spline-strip includes a spline which, when the spline-strip is applied to a wall, protrudes from the wall;

characterised in that the spline includes left and right side-wall components a roof component and a floor component, of the spline;

in that the components of the spline are arranged to form a hollow so box-shaped enclosure;

and in that the side-wall components protrude outwards away from the base or web, and the floor component of the spline comprises a portion of the base or web which extends between the side walls;

the wood trim is a unitary structure having the same cross-sectional profile alone its length;

the cross-sectional profile of the trim includes a groove, and the groove is sized to be a light fit on the spline.

2. Assembly of claim 1, wherein the roof of the hollow spline is slightly curved or dished inwards.

3. Assembly of claim 2, wherein the outer walls of the hollow spline are provided with small, radiused, promontories.

4. Assembly of claim 2, wherein the spline-strip includes a protruding rib, which, when the spline-strip is applied to a wall, protrudes from the wall;

the protruding rib is resilient in the direction defined by the plane of the cross-section and the plane of the wall.

5. Assembly of claim 1, wherein the spline-strip includes a protruding bar, which, when the spline-strip is applied to a wall, protrudes inwards, into the plane of the wall.

6. Assembly of claim 4, wherein the spline-strip includes a protruding bar, which, when the spline-strip is applied to a wall, protrudes inwards, into the plane of the wall, and wherein, in cross-sectional profile of the spline-strip, the hollow spline lies towards one end of the base or web, the bar lies towards the other end of the base or web, and the rib lies intermediate therebetween and closer to the bar than to the spline.

7. Assembly of claim 1, wherein:

the spline strip includes a protruding rib, which, when the spline-strip is applied to a wall, protrudes from the wall;

the protruding rib is lightly and resiliently deformable in the direction defined by the plane of the cross-section and the plane of the wall;

the profile of the trim includes a face which is so arranged that, when the trim is assembled to the spline-strip, the face is resiliently engaged by the protruding rib in the said direction;

the arrangement of the rib and the face are such that the friction created by the engagement therebetween acts to resist the trim being dislodged from the spline-strip.

8. Assembly of claim 7, wherein the resilience of the rib and the orientation of the face are so disposed as to stress the profile of the trim in compression and the profile of the spline-strip in tension.

9. Assembly of claim 1, wherein the apparatus includes vertical-lying and horizontal-lying lengths of the said trim, and corresponding lengths of the spline-strips, the lengths being all pre-cut and pre-mitred, and accurately matched.

10. Assembly of claim 9, wherein the vertical-lying and horizontal-lying lengths of trim are pre-formed into a sub-assembly of matching pieces.

11. Assembly of claim 10, wherein the apparatus includes also corresponding door-jamb-pieces, all pre-cut and accurately matched;

the jamb-pieces are provided with grooves along the edges thereof;

and the spline-strips are provided with bars, located on the back of the web, which engage the grooves in the edges of the jamb-pieces.

12. Assembly of claim 10, wherein the horizontal-lying and vertical-lying lengths of trim include means engageable with both lengths at a mitred corner, the means being suitable for holding the lengths of trim together against relative movement in the direction perpendicular relative to the wall.

13. Assembly of claim 1, wherein the fit of the groove to the spline, after assembly, across the width of the groove, is between zero clearance and ¼ mm clearance.

14. Assembly of claim 13, wherein one of either the groove or the spline is tapered, to the extent that the clearance between the groove and the spline, upon presentation of the groove to the spline just prior to assembly is about ½ mm.

15. Assembly of claim 1, wherein the groove and the spline are plain-sided, in that the sides of the grooves and splines include no protrusions or beads or re-entrant aspects, and in that the fit of the trim to the spline is such that the wood of the trim is not, in substance, required to flex resiliently, upon engagement.

16. Assembly of claim 1, wherein the distance apart of the side surfaces of the spline is, in substance, not more than the distance apart of the side surfaces of the groove, whereby the fit of the spline to the groove, when assembled, at a particular cross-sectional location thereof, is not an interference fit.

17. Assembly of claim 1, wherein:

the spline strip includes a protruding tongue, which, when the spline-strip is applied to a wall, protrudes from the wall;

the tongue lies at an angle other than a right angle relative to the base or web;

the trim includes a slot, which is correspondingly angled;

upon application of the trim to the spline strip, the groove in the trim engages the spline, and the slot in the trim engages the tongue;

the spline-strip and the trim are so dimensioned that the engagement of the groove over the spline drives the tongue deeper into the slot;

the spline-strip and the trim are so dimensioned that driving the tongue deeper into the groove creates a force acting in the sense tending to urge the portion of the trim adjacent to the slot towards the wall, and by reaction tending to urge the tongue away from the wall;

the apparatus includes means for constraining deflection of the tongue away from the wall.

18. Wood trim apparatus, which includes a trim-mounting spline-strip (150) for attaching the wood trim (176) to a wall, around doors and windows, baseboards, corner mouldings, or the like, wherein:

the spline-strip is of plastic, and is elongate, and comprises a unitary structure having the same cross-sectional profile at all points along its length;

the cross-sectional profile of the plastic spline-strip includes a base or web (152), which is adapted for direct application to a flat surface of a wall;

the cross-sectional profile of the plastic spline-strip includes a spline (154), which, when the spline-strip is applied to a, wall, protrudes from the wall;

characterised in that the spline includes left and right side-wall components (156;238), a roof component (232), and a floor component, of the spline;

in that the components of the spline are arranged to form a hollow box-shaped enclosure;

in that the side-wall components protrude outwards away from the base or web, and the floor component of the spline comprises a portion of the base or web which extends between the side walls;

in that the apparatus includes two of the spline-strips, and a corner piece;

and in that the corner piece is profiled to fit snugly inside the hollow interiors of the splines of the spline-strips, and is so shaped that, when placed in the hollow interiors of the two spline-strips arranged in a 90-degree mitred corner, the corner-piece is effective to hold and constrain the spline-strips in the said mitred corner against relative movement.

19. Wood trim apparatus, which includes a trim-mounting spline-strip (150) for attaching the wood trim (176) to a wall, around doors and windows, baseboards corner mouldings, or the like, wherein:

the spline-strip is of plastic, and is elongate, and comprises a unitary structure having the same cross-sectional profile at all points along its length;

the cross-sectional profile of the plastic spline-strip includes a base or web (152), which is adapted for direct application to a flat surface of a wall;

the cross-sectional profile of the plastic spline-strip includes a spline (154), which, when the spline-strip is applied to a wall, protrudes from the wall;

characterised in that the spline includes left and right side-wall components (156;238), a roof component (232), and a floor component, of the spline;

in that the components of the spline are arranged to form a hollow box-shaped enclosure;

in that the side-wall components protrude outwards away from the base or web, and the floor component of the spline comprises a portion of the base or web which extends between the side walls;

in that the apparatus includes two of the spline-strips, and a corner piece;

and in that the two spline-strips are welded together into a corner assembly, having the form of a 90-degree mitred corner.

20. Apparatus which comprises, as a kit, two of the said welded corner assemblies of the spline-strip of claim 19, having short arms, the arms having square ends;

one horizontal-lying length of the spline-strip, cut square both ends;

two vertical-lying lengths of the spline-strip, cut square both ends;

to one horizontal-lying length of trim, being trim of a unitary structure having the same cross-sectional profile along its length, wherein the cross-sectional profile of the trim includes a groove, and the groove is sized to be a light fit on the spline;

and two vertical-lying lengths of the said trim, each mitred one end.

21. Apparatus which comprises two of the kits as claimed in claim 20 being an inside kit and an outside kit, wherein:

the apparatus includes a horizontal-lying and two vertical-lying door-jamb-pieces;

the jamb-pieces are provided with grooves along the edges thereof;

the spline-strips in the kits are provided with bars, located on the back of the web, which engage the grooves in the edges of the jamb-pieces;

the arrangement of the assembly is such that, upon application thereof to a doorframe in a wall, and upon securement of the splines to the wall, the door-jamb-pieces, in the absence of direct fixing of the door-jamb-pieces to the doorframe, are held rigidly with respect to the wall.

22. Assembly of claim 19, wherein the corner piece has arms of unequal length, the longer arm having a length of at least 1.5 meters, and the short arm having a length of no more than 40 cm.

23. Wood trim apparatus, which includes a trim-mounting spline-strip (150) for attaching the wood trim (176) to a wall, around doors and windows, baseboards, corner mouldings, or the like, wherein:

the spline-strip is of plastic, and is elongate, and comprises a unitary structure having the same cross-sectional profile at all points along its length;

the cross-sectional profile of the plastic spline-strip includes a base or web (152), which is adapted for direct application to a flat surface of a wall;

the cross-sectional profile of the plastic spline-strip includes a spline (154), which, when the spline-strip is applied to a wall, protrudes from the wall;

characterised in that the spline includes left and right side-wall components (156;238), a roof component (232), and a floor component, of the spline;

in that the components of the spline are arranged to form a hollow box-shaped enclosure;

in that the side-wall components protrude outwards away from the base or web, and the floor component of the spline comprises a portion of the base or web which extends between the side walls;

in that the spline-strip includes a protruding rib, which, when the spline-strip is applied to a wall, protrudes from the wall;

in that the protruding rib is resilient in the direction defined by the plane of the cross-section and the plane of the wall;

and in that the spline-strip includes a protruding bar, which, when the spline-strip is applied to a wall, protrudes inwards, into the plane of the wall, and wherein, in cross-sectional profile of the spline-strip, the hollow spline lies towards one end of the base or web, the bar lies towards the other end of the base or web, and the rib lies intermediate therebetween and closer to the bar than to the spline.

* * * * *